US009086256B2

(12) United States Patent
Schweitzer

(10) Patent No.: US 9,086,256 B2
(45) Date of Patent: Jul. 21, 2015

(54) TEMPORARY OFFENSE FOR ULTIMATE CONTROL AGAINST HARM

(76) Inventor: Robert Martin Schweitzer, Columbia, MD (US)

( * ) Notice: Subject to any disclaimer, the term of this patent is extended or adjusted under 35 U.S.C. 154(b) by 9 days.

(21) Appl. No.: 12/929,093

(22) Filed: Mar. 24, 2011

(65) Prior Publication Data

US 2012/0243141 A1 Sep. 27, 2012

(51) Int. Cl.
*F41B 15/04* (2006.01)
*F41H 13/00* (2006.01)

(52) U.S. Cl.
CPC ..... *F41H 13/0018* (2013.01)

(58) Field of Classification Search
CPC ..... F41B 15/04
USPC ..... 361/232, 230
See application file for complete search history.

(56) References Cited

U.S. PATENT DOCUMENTS

| | | | | |
|---|---|---|---|---|
| 4,370,696 | A * | 1/1983 | Darrell | 361/232 |
| 4,485,426 | A * | 11/1984 | Kerls | 361/232 |
| 7,477,504 | B1 * | 1/2009 | Delida | 361/230 |
| 2004/0154071 | A1 * | 8/2004 | Frahm | 2/160 |
| 2010/0093457 | A1 * | 4/2010 | Ahern et al. | 473/202 |

* cited by examiner

*Primary Examiner* — Rexford Barnie
*Assistant Examiner* — Joseph Inge
(74) *Attorney, Agent, or Firm* — Merek, Blackmon & Voorhees, LLC

(57) ABSTRACT

The device is a self-contained-defense-system. The entire unit is housed inside a blended set of athletic gloves and emits an electrical charge against an unwanted attacker. It can be utilized by men or women, both young and old, for personal safety. The electrical charge emitted is not strong enough to kill, but the voltage can be increased in order to assist the military and the police.

14 Claims, 5 Drawing Sheets

TEMPORARY OFFENSE FOR ULTIMATE CONTROL AGAINST HARM

BACKGROUND

This is something new and unparalleled to assist people, especially women, remain safe in today's crazy world.

The device is a self-contained-defense-system. The entire unit is housed inside a blended set of athletic gloves and emits an electrical charge against an unwanted attacker. It can be utilized by men or women, both young and old, for personal safety. The electrical charge emitted is not strong enough to kill but the voltage can be increased in order to assist the military and the police.

SUMMARY OF THE INVENTION

Too many people have the false hope that they will be safe if they carry a small knife, mace or a stun gun when they go outside to walk or run. Imagine the young professional female out running in the early morning or walking home late at night from work with her iPod plugged into both ears. The woman is basically oblivious to her surroundings and is therefore a prime candidate for an unwanted attack.

The advantage of The T.O.U.C.H. is that the victim is always prepared for that unprovoked assault. Nearly, every day there is a news-piece about some young girl or woman that has been attacked, beaten, raped or killed. In these types of situations, The T.O.U.C.H. is perfect to have at your fingertips because it could make the difference between life or death.

The actually invention, is the controlled shock and repelling application against an attacker. The purpose and advantage of The T.O.U.C.H. is to basically save a human life.

DETAILED DESCRIPTION

Figure 1:
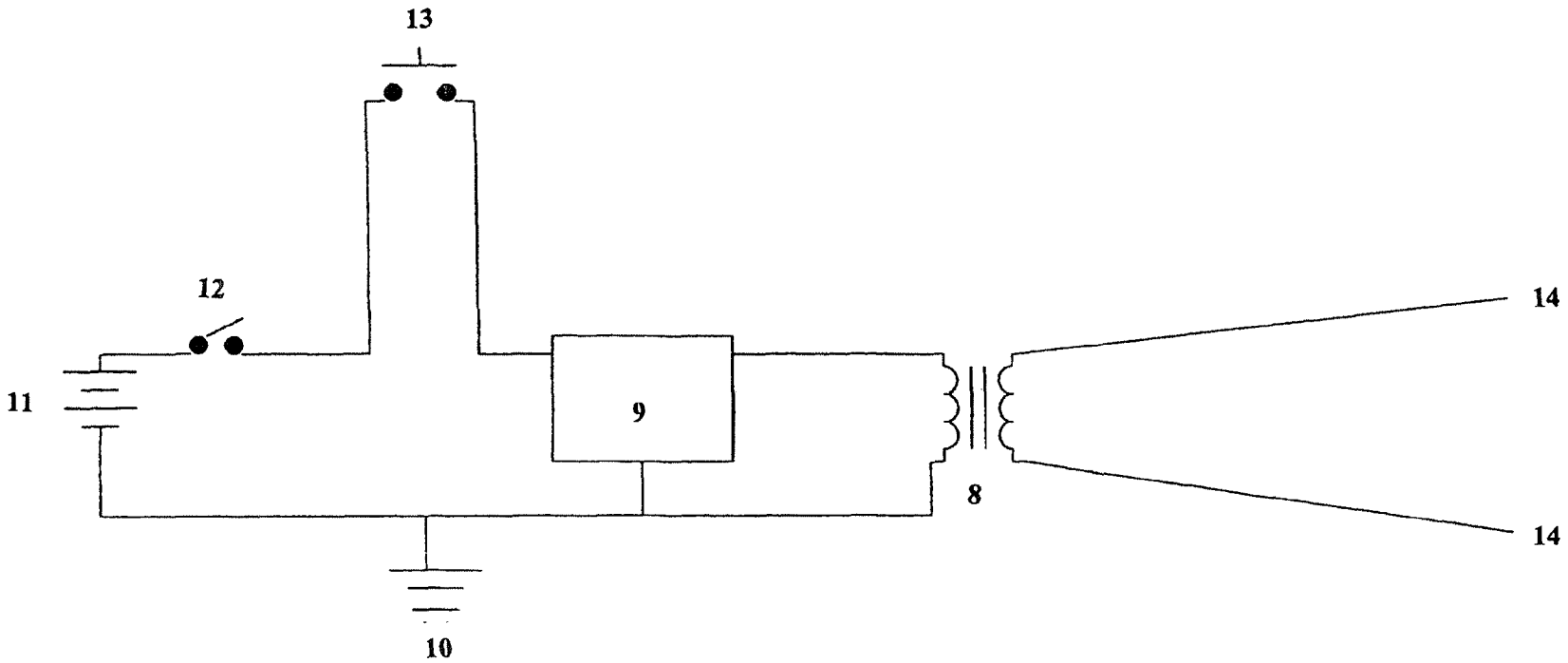

FIG. 1: Shows the schematic of the electronics.

Figure 2:
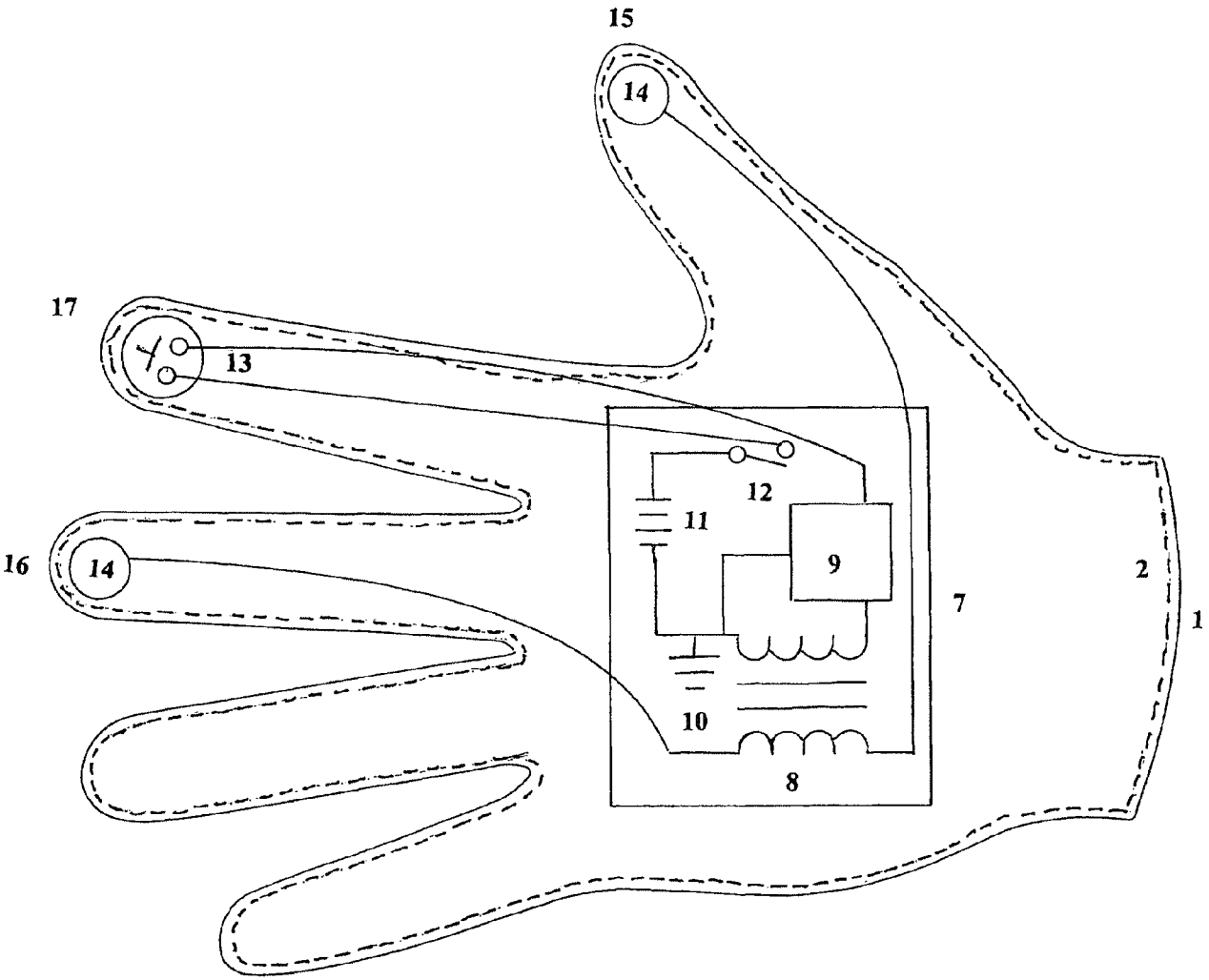

FIG. 2: Shows the components, top view of both the cloth and the invisible view of the rubber glove.

Figure 3:
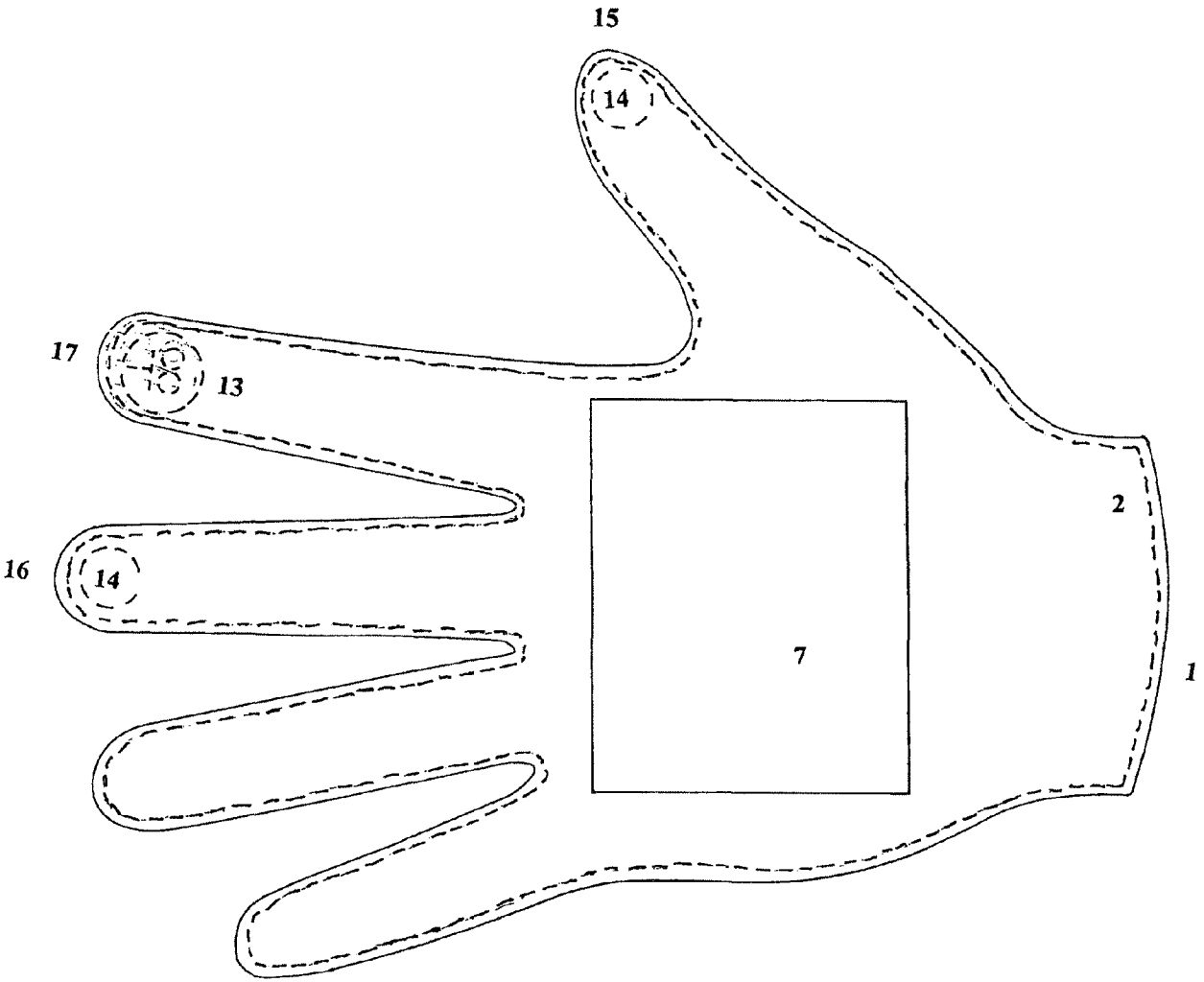

FIG. 3: Shows the top view of the cloth glove, invisible view of the rubber glove, velcro pocket, the invisible view of the secondary momentary tact switch and both invisible contact points.

Figure 4:
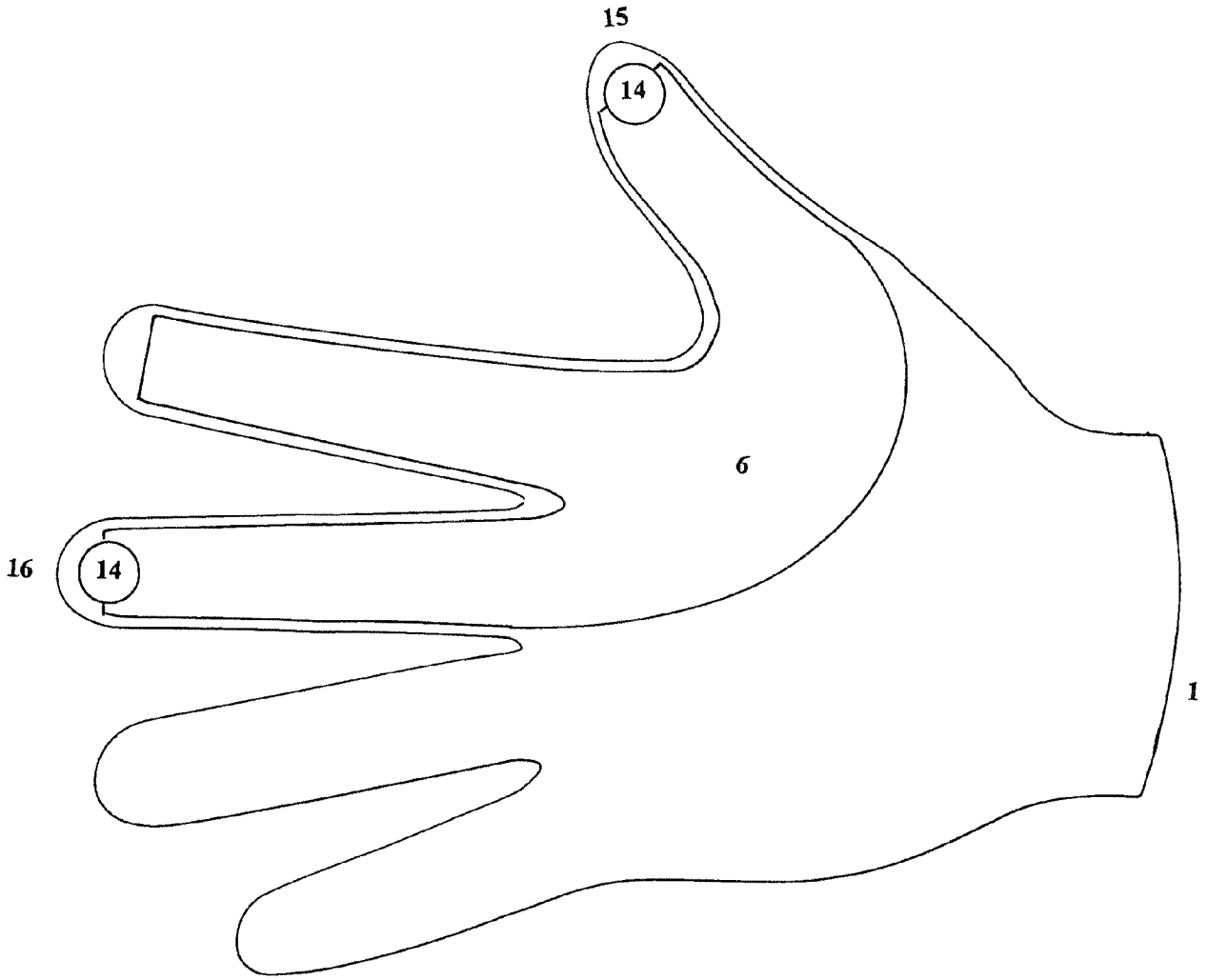

FIG. 4: Shows the bottom view of the glove, both contact tips and electrical conductive cloth.

Figure 5:
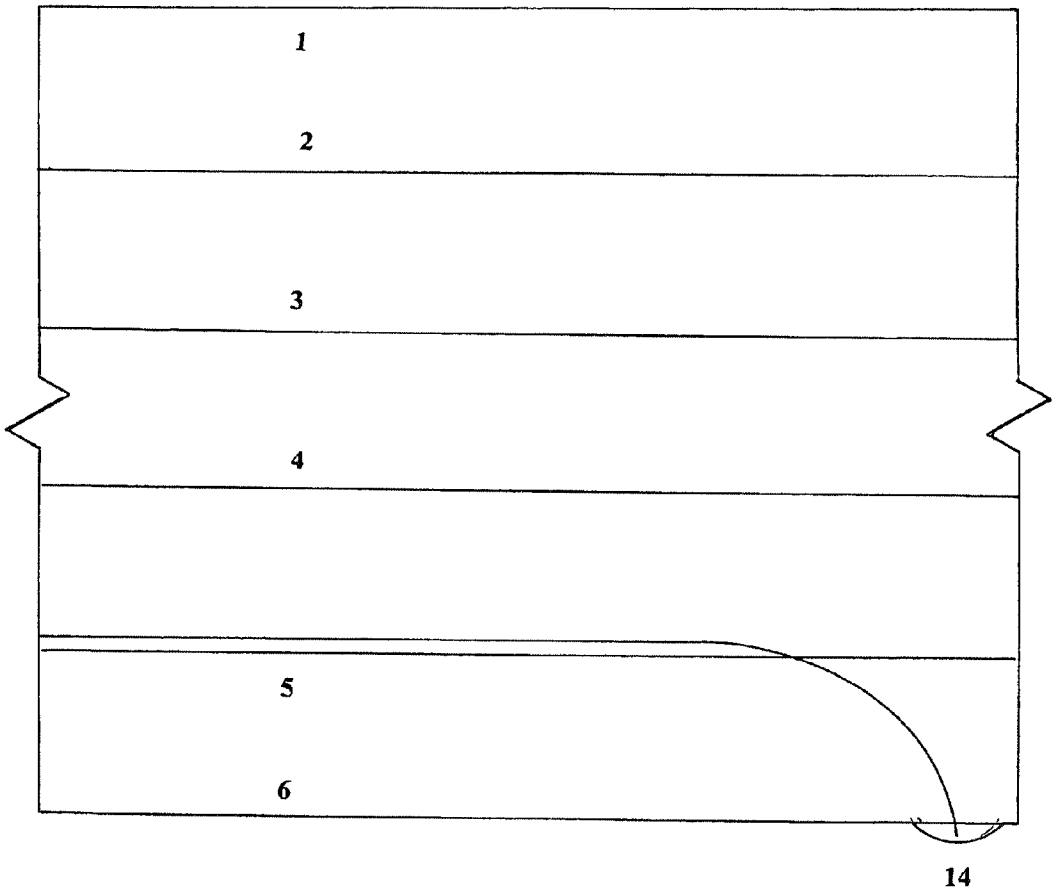

FIG. 5: Shows the enlarged cross section view of the blended set of both rubber and cloth gloves including where the hand fits.

This is a detailed description of the The T.O.U.C.H. (Temporary Offense for Ultimate Control against Harm). The invention is a self-contained, personal, protective device which I have developed.

The apparatus emits a momentary, electrical charge against an unwanted attacker for personal safety. The entire unit is housed completely inside a modified set of athletic gloves.

Please refer to FIG. 1, it shows the schematic layout of the electronics. It also details the transformer (8) the AC/DC converter (9) the ground (10) the battery (11) the primary power switch (12) the secondary momentary tact switch (13) and both contact points (14).

Please refer to FIG. 2, it shows the electrical component's, the top view of both the cloth (1) and rubber (2) gloves. First, the primary power switch (12) is connected to the secondary momentary tact switch (13) which is connected to the battery (11). From there the battery (11) is connected to the ground (10) and the transformer (8) and the AC/DC converter (9). The two contact points (14) are located on the thumb (15) and the middle index finger (16). The contact points (14) are connected directly to the transformer (8). The transformer (8) is connected to the AC/DC converter (9). The entire unit is housed inside the velcro pocket (7) on the back of each cloth glove (1).

The full power comes from three button-cell batteries (11) also hidden inside the velcro pocket (7) on the back of each cloth glove (1). There is a total of four wires and two small metal contact points (14). The contact points (14) are located on the tips of the thumb (15) and the middle index finger (16) of each cloth glove (1).

A DC/AC converter (9) in conjunction with the transformer (8) generates the controlled shock that is released through the contact points (14) on the thumb (15) and the middle index finger (16) coupled with the electrical conductive cloth (6) on each of the outer part of the cloth gloves (1).

In order to utilize the controlled shock, both metal contact points (14) must engage and make physical contact with the assailant. At that point the victim applies minimal pressure to the secondary miniature tact momentary switch (13) inside the rubber glove (2) on the first index finger (17) permitting a brief shock to be generated through the two contact points (14) and the electrical conductive cloth (6).

The sudden electrical emission is not strong enough to kill the attacker. The electrical emission is a sufficient amount of a discharge that is released through the contact points (14) on the thumb (15) and the middle index finger (16) and electrical conductive cloth (6) to stun the attacker momentarily, allowing the victim to break free and escape.

Please refer to FIG. 3, it shows the top view of the glove, the invisible view of the rubber glove (2) the invisible view of the two metal contact points (14) that releases and administers the electrical shock against the attacker. The invisible view of the secondary momentary tact switch (13) which is located on the first index finger (17).

The two metal contact points (14) are located on the thumb (15) and the middle index finger (16) of each cloth glove (1). The velcro-components pocket (7) located on the back of each cloth glove (1) is where the electronics is located.

On the tip of each glove's first index finger (17) located inside of the rubber glove (2) is a secondary miniature tact momentary switch (13). The secondary miniature tact momentary switch (13) activates the electrical charge and is released through each of the metal contact points (14). The metal contact points (14) are located on each of the thumbs (15) and the middle index fingers (16) on both cloth gloves (1).

The secondary miniature tact momentary switch (13) is hidden underneath the first index finger (17) of each of the rubber (2) and the cloth glove (1). The secondary miniature tact momentary switch (13) instantly activates the electrical defense system when the victim physically engages the unwanted attacker.

Please refer to FIG. 4, it shows the special electrical conductive cloth (6). Its purpose is to increase the shock area of the glove in conjunction with the contact points (14) on the thumb (15) and the middle index finger (16) of each cloth glove (1).

Please refer to FIG. 5, it shows an enlarged cross section of the blend of both the cloth (1) and the rubber glove (2). The rubber part of the blend, where the hand is seated (3), prevents the victim from shocking themselves while storing the electronics in a hidden velcro pocket (7) on the back of each cloth glove (1). The electrical components, inside of the velcro pocket (7) generate the charge used to deter the attacker.

In addition, FIG. 5, details the cross section of both the cloth (1) and the rubber (2) gloves' unit. The drawing, depicts where the hand (3) is inserted and firmly seated. The top of the glove is the first cloth layer (1). Immediately below is the second layer glove which is rubber (2). The middle part of the drawing is where the hand fits (3).

Inverting the process, the next layer under the palm of the hand is the bottom side of the second glove which is rubber (4). In between the cloth (1) and rubber gloves' section (2) is one of two wires running along the thumb (15) and middle index fingers (16) which is connected to a metal contact point (14) on the thumb (15) and the middle index finger (16).

The last part is the bottom of the cloth glove (5). Attached to the cloth glove is a separate piece of electrical conductive cloth (6) which increases the shock area. Attached to the conductive cloth (6) is one of the two metal-conductive tips (14). There is a metal contact tip (14) on the end of each of the thumb (15) and each middle index finger (16) of the outer portion of the cloth glove (1).

I claim:

1. A protective device for emitting a nonlethal electrical charge against an unwanted attacker, the protective device comprising:

(a) an electrical system for emitting a nonlethal electrical charge against an unwanted attacker, said electrical system including a power source, a first contact member having a first shock area for transmitting the nonlethal electrical charge against an unwanted attacker, the first contact member being connected to the power source, a second contact member having a second shock area for transmitting the nonlethal electrical charge against an unwanted attacker, the second contact member being connected to the power source, the electrical system further including at least one activation member for activating said electrical system to emit a nonlethal electrical charge against an unwanted attacker;

(b) at least one glove to be worn on a hand of a user, said at least one glove including a first layer, a second layer and a third layer, said first layer being disposed between said second layer and the hand of the user, said second layer being disposed between said third layer and said first layer;

(c) at least a portion of said electrical system being disposed between an outermost surface of said second layer and an innermost surface of said first layer, said first layer being configured to prevent the nonlethal electrical charge from being transmitted to the user wearing said at least one glove; and, (d) said third layer being electrically coupled to at least one of said first contact member and said second contact member, said third layer having a third shock area for transmitting the nonlethal electrical charge against an unwanted attacker, said third shock area forming a single shock area.

2. The protective device of claim 1, wherein:

(a) said first layer is an inner glove having a plurality of finger portions and a thumb portion; and, (b) said second layer is an outer glove having a plurality of finger portions and a thumb portion.

3. The protective device of claim 1, wherein:

(a) said third layer is an electrically conductive cloth electrically coupled to said first contact member and said second contact member, said third shock area of said third layer covers at least a portion of a user's thumb, at least a portion of a user's palm and at least a portion of at least one finger of a user.

4. The protective device of claim 3, wherein:

(a) said third shock area of said third layer covers at least a portion of a user's index finger and at least a portion of a user's middle finger.

5. The protective device of claim 2, wherein:

(a) said outer glove includes a hidden pocket for storing at least a portion of said electrical system.

6. The protective device of claim 1, wherein:

(a) said at least one activation member includes a power switch and a momentary switch, said electrical system being configured such that the nonlethal electrical charge is generated only upon activation of said power switch and said momentary switch.

7. The protective device of claim 6, wherein:

(a) said momentary switch is disposed in an index finger portion of said at least one glove.

8. The protective device of claim 7, wherein:

(a) said power switch is disposed in a hidden pocket in said at least one glove.

9. The protective device of claim 1, wherein:

(a) said first contact member is on an index finger portion of said at least one glove and said second contact member is disposed on a thumb portion of said at least one glove.

10. The protective device of claim 1,wherein:

(a) said electrical system generates an electromotive force of 17.5 volts.

11. A protective device for emitting a nonlethal electrical charge against an unwanted attacker, the protective device comprising:

(a) an electrical system for emitting a nonlethal electrical charge against an unwanted attacker, said electrical system including a power source, a first contact member having a first shock area for transmitting the nonlethal electrical charge against an unwanted attacker, said first contact member being connected to said power source, a second contact member having a second shock area for transmitting the nonlethal electrical charge against an unwanted attacker, said second contact member being connected to said power source, said electrical system further including at least one activation member for activating said electrical system to emit a nonlethal electrical charge against an unwanted attacker;

(b) at least one glove to be worn on a hand of a user, said at least one glove being configured to prevent the nonlethal electrical charge from being transmitted to the user wearing the at least one glove, said at least one glove being connected to said electrical system; and, (c) said at least one glove having an electrically conductive layer having a third shock area for transmitting the nonlethal electrical charge against an unwanted attacker, said third shock area forming a single shock area, said third shock area covering at least a portion of the user's thumb and at least a portion of at least one of the user's fingers.

12. The protective device of claim 11, wherein:

(a) said third shock area covers at least a portion of the user's index finger and at least a portion of the user's palm.

13. The protective device of claim 12, wherein:

(a) said first contact member and said second contact member connect said electrically conductive layer to said power source, said first contact member being disposed on a thumb portion of said at least one glove and said second contact member being disposed on an index finger of said at least one glove.

14. The protective device of claim 11,wherein:

(a) said electrical system generates an electromotive force of 17.5 volts.

* * * * *